United States Patent [19]

Jungbert, Sr.

[11] Patent Number: 4,483,361

[45] Date of Patent: Nov. 20, 1984

[54] ANTI-SYPHON FROST-PROOF HYDRANT

[76] Inventor: Edward J. Jungbert, Sr., 12900 North Osage Rd., Louisville, Ky. 40223

[21] Appl. No.: 206,723

[22] Filed: Nov. 14, 1980

Related U.S. Application Data

[63] Continuation-in-part of Ser. No. 971,329, Dec. 20, 1978, abandoned.

[51] Int. Cl.[3] ..... E03B 9/14

[52] U.S. Cl. ..... 137/301; 137/512; 137/533.11; 137/DIG. 2; 251/82; 251/83; 251/228

[58] Field of Search ..... 137/107, 61, 272, 300, 137/301, 307, 493, 498, 512, 533.11, 843, DIG. 2; 251/83, 85, 228, 303, 319, 321, 82, 298

[56] References Cited

U.S. PATENT DOCUMENTS

| | | | |
|---|---|---|---|
| 140,006 | 6/1873 | Brown | 251/83 |
| 841,133 | 1/1907 | Farrell | 137/DIG. 2 |
| 981,087 | 1/1911 | Hoyt | 251/83 |
| 994,268 | 6/1911 | Milne | 137/DIG. 2 |
| 1,021,537 | 3/1912 | Lawrin | 137/301 |
| 1,541,757 | 6/1925 | Allen | 251/83 |
| 2,151,296 | 3/1939 | Knoerzer | 251/228 |
| 2,447,968 | 8/1948 | Trotter | 251/321 |
| 2,985,358 | 5/1961 | Lee et al. | 137/533.13 |
| 3,626,518 | 12/1971 | Leibinsohn | 137/533.11 |
| 3,980,097 | 9/1976 | Ellis | 137/307 |

FOREIGN PATENT DOCUMENTS

| | | | |
|---|---|---|---|
| 1124014 | 10/1956 | France | 137/301 |
| 62285 | 10/1912 | Switzerland | 251/228 |

*Primary Examiner*—George L. Walton

*Attorney, Agent, or Firm*—Edward M. Steutermann

[57] ABSTRACT

An anti-syphon, frost-proof hydrant including a lower body having a fluid inlet, and a fluid outlet defined therein, with a valve seat provided within the outlet where standpipe enclosure member is provided and adapted to be secured to the lower body around the valve seat, to provide a fluid conduit, having and outlet end connected to an upper body having a fluid inlet communicating with the standpipe outlet and a fluid outlet, a valve operator carried by the upper body including a stem member extending downwardly through the upper member and the standpipe and adapted to carry a valve member on the end thereof disposed in aligned relation with the valve seat so the valve member outlet is open and closed by movement of the stem member and where an anti-syphon drain port is provided in the lower body member and adapted to receive an anti-syphon drain device including an enclosure defining a chamber, and adapted to be received in the port, where valve seat means are disposed within the chamber with valve means operable from a first valve open position when there is no water pressure in the standpipe to second valve closed position when water pressure exists in the standpipe.

5 Claims, 11 Drawing Figures

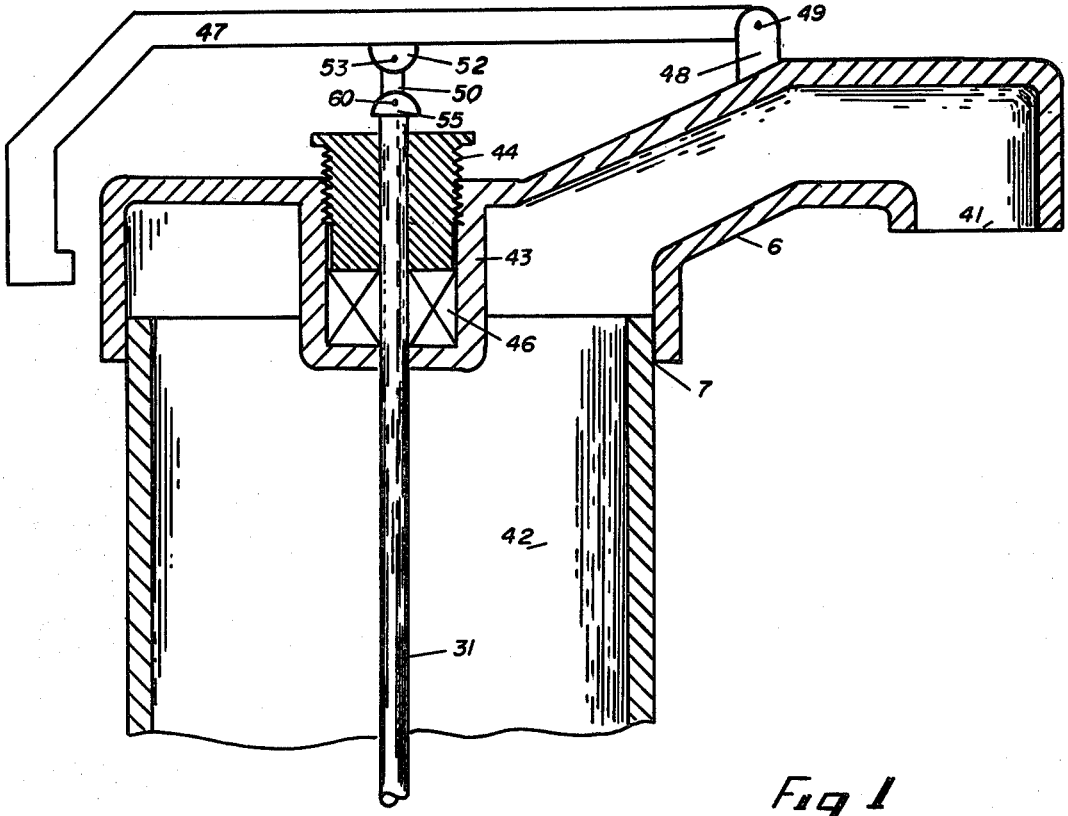
Fig 1
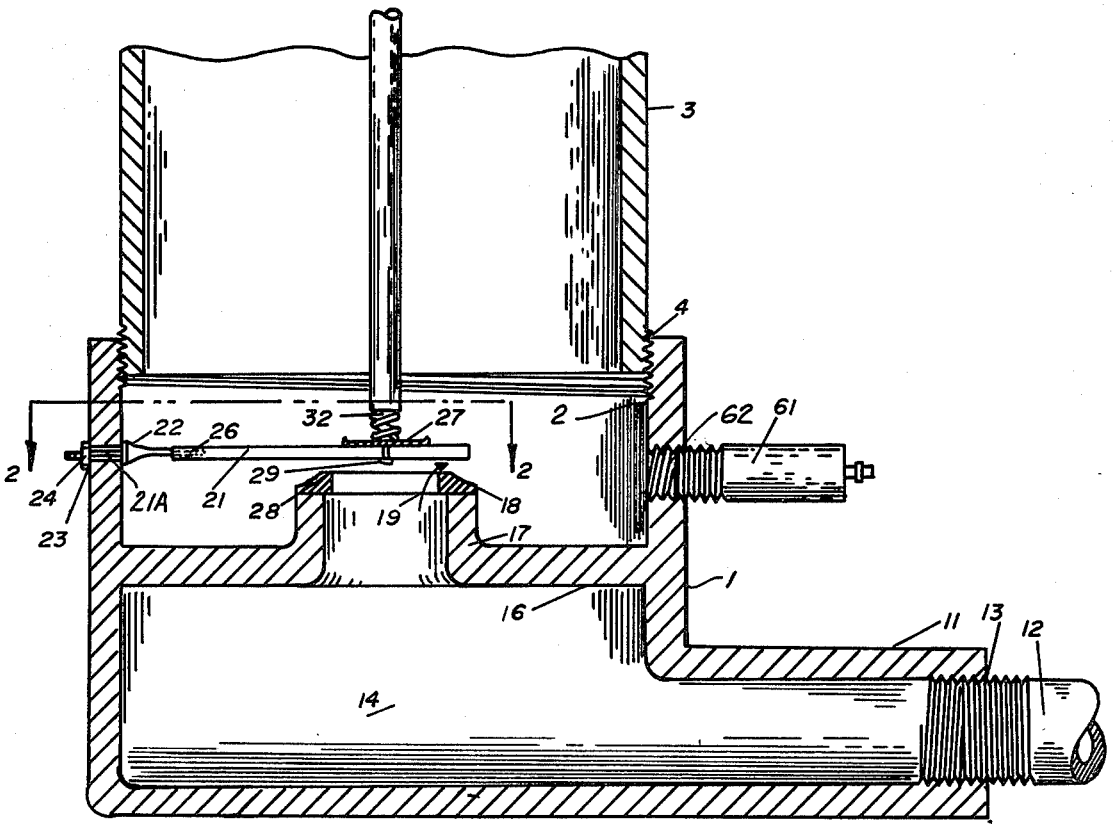

ANTI-SYPHON FROST-PROOF HYDRANT

BACKGROUND OF THE INVENTION

This application is a continuation in part of my copending application Ser. No. 971,329 filed Dec. 20, 1978, now abandoned.

The present invention relates to a hydrant valve type arrangement. The most common type hydrant valve is, of course, the fire hydrant. Generally, hydrant type valves are provided with a fluid connection beneath ground level, a standpipe extension vertically upward where the valve seat means are located adjacent ground level in the bottom of the hydrant. The valve operator means is located atop the hydrant so that the fluid is admitted at the bottom of the standpipe, flows upwardly through the standpipe and then outwardly through a cooperative outlet.

Other types of hydrant valves are commonly used for agricultural or gardening purposes to provide a source of water for watering a selected area or in some instances for filling water holding devices.

The advantage of hydrant type arrangements is that the operative valve member, is safely located within a casing and in most instances, adjacent ground level so that any damage suffered by the hydrant is limited to the standpipe or the portion of the hydrant above ground and the portion of the hydrant adjacent ground level, which is usually the more expensive part, is least less likely to be damaged. Also, by locating the valve seat at ground level water can be excluded from the standpipe to diminish likelihood of freezing in cold weather.

Such arrangements have several disadvantages. For example with the valve member adjacent ground level, and since the standpipe is filled with water when the device is operating, and particularly in instances where a hose is connected to the outlet of the hydrant and the hydrant has been turned off, but the valve or valve seat is defective, the surface water is syphoned through the hose and into the hydrant water supply. Such a situation is particularly undesirable when the hydrant is supplied by a source of potable water so that the possibility exists that a malfunction of the hydrant can contaminate a supply of drinking water.

One further disadvantage of hydrants is that since the standpipe ordinarily is full of liquid after use, the occurence of cold weather can result in freezing of the water in the standpipe. Although it is not likely that the valve itself will freeze because of its exposure to flowing water the standpipe can rupture, so the valve is rendered inoperable.

For the foregoing reasons, the utilization of hydrants has been somewhat restricted so that hydrants may not be provided in situations where they would otherwise be useful.

SUMMARY OF THE INVENTION

The present invention provides a straightforward anti-syphon, freeze-preventative, hydrant arrangement.

Arrangements provided by the present invention are, if any, only slightly more expensive than presently available hydrants but have the added advantage that arrangements within the scope of the present invention provide a means to prevent syphoning surface water into potable water supply means. More particularly, the present invention provides a straightforward arrangement utilizing a two-way valve member at the lower end of the hydrant to operate from a first open position when the hydrant standpipe is not under pressure to permit drainage of water from the standpipe when not in use and to prevent freezing and syphoning of surface water into the hydrant, to a second closed position when the hydrant standpipe is under pressure so that it operates normally.

Various other features of the present invention will become obvious to those skilled in the art upon reading the disclosure set forth hereinafter.

BRIEF DESCRIPTION OF THE DRAWINGS

Referring now to the drawings which show one arrangement in accordance with the present invention:

FIG. 1 is a view in section of a typical hydrant including arrangements within the scope of the present invention;

With reference to FIG. 1, a hydrant arrangment is provided including a lower body 1 having an outlet 2 where a standpipe 3 is received in outlet 2, for example by means of cooperative threads 4 (not shown) at the lower end of the standpipe 3 and the outlet end 2 of the lower body 1. At the upper end, standpipe 3 is connected to an upper body 6, by means of cooperative threads 7 (not shown). The lower body 1 includes an inlet 11 adapted to receive an inlet conduit 12 by means of cooperative threads 13. An inlet chamber 14 is defined within the lower body 1 between the outer wall of body 1 and an intermediate wall 16 where intermediate wall 16 defines a valve seat support 17 carrying a valve seat 18 having a sealing surface 28 as is known in the art. Normal fluid flow is in the direction indicated by arrow 19.

Figure 2:
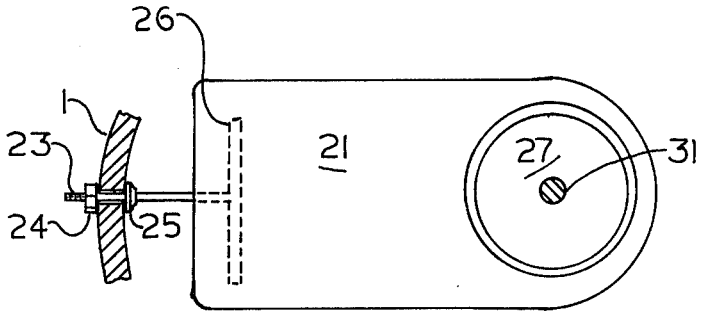
FIG. 2, is a view taken along a plane passing through line 2—2 of FIG. 1.

A valve member is provided to close on seat 18 and in the example shown in FIG. 1, a flap seat including a valve member 21 is provided which, advantageously, can be of a flexible material such as Neoprene (TM, E. I. Dupont, Inc.). Valve member 21 is secured to the outer casing of lower body 1 by means a fastener assembly 22 which includes a post 22A extending through a cooperative aperture 23 in the wall of casing 1 and retained by a nut 24.

A pivot arrangement, as shown in FIG. 2, can be provided where fastener 22 includes a "T" member 26 encased within the body of valve member 21. The "T" arrangement is provided to facilitate operation of valve member 21 and reduce the likelihood of flex failure of valve 21.

To further facilitate operation of valve 21, a cup washer 27, having a diameter approximately equal to the upper diameter of the sealing edge 28 of valve seat 18, can be provided on the upper side of valve member 21 and retained by a fastening device, for example a rivet 29, which extends through valve member 21. Cup washer 27 is connected to a valve stem 31 by means of a spring 32 so that cup washer 27 and valve member 21 are free to move in response to the pressure of fluid admitted through valve seat 18 and asserted on the bottom side of valve 21. Spring 32 can, for example, be a compression spring to prevent overstressing of cup washer 27 when valve member 21 is closed by stem 31. Furthermore spring 32 will permit inclination of valve member 21 to an angle with respect to a line transverse to the longitudinal axis of stem 31 to effectively reduce the pressure drop experienced by the fluid flowing through valve seat 18.

The upper valve body 6 can be provided with an outlet 41 communicating with the chamber 42 defined with standpipe 3. Valve stem 31 extends upwardly through chamber 42 to a packing joint 43 defined within upper body 6. As is known in the art, a packing nut 44 can be provided to compress a ring of packing 46 to prevent leakage around valve stem 31. A handle 47 is provided and connected to upper valve member 6 by means of a bracket 48 and a pin member 49 so that handle 47 is pivoted about bracket 48. A second bracket 52 is provided on the lower side of handle 47 and is pivotably connected to one end of a linkage 50 by a pin 53 where the other end of linkage 53 is pivotably connected to a bracket 55 means of a pin 60. Bracket 55 is carried by the upper end of valve stem 31 so that valve stem 31 is lifted and lowered by appropriate movement of handle 47.

In accordance with one feature of the present invention, an anti-syphon valve assembly 61 is provided in the lower body 1 and is described in more detail in FIG. 3 described hereinafter. Anti-syphon valve 61 is received within an opening 62 provided in lower valve body 1.

With reference to FIG. 2, it will be seen that the valve member 21 is of generally rectangular shape adapted to receive cup washer 27. "T" member 26 which can, for example, be molded into valve member 21, is useful in providing structural stability to valve member 21.

It would further be recognized, that within the scope of the present invention, the valve arrangement, including valve member 21 as shown also discourages syphoning in the event of failure of the water supply from inlet conduit 12 by means of compression spring 32 and the flexibility of valve member 21 so that any inclination toward reverse flow of fluid will automatically extend spring 32 and deform valve member 21 so that the differential in pressure closes valve member 21 on valve seat 18.

Figure 3:
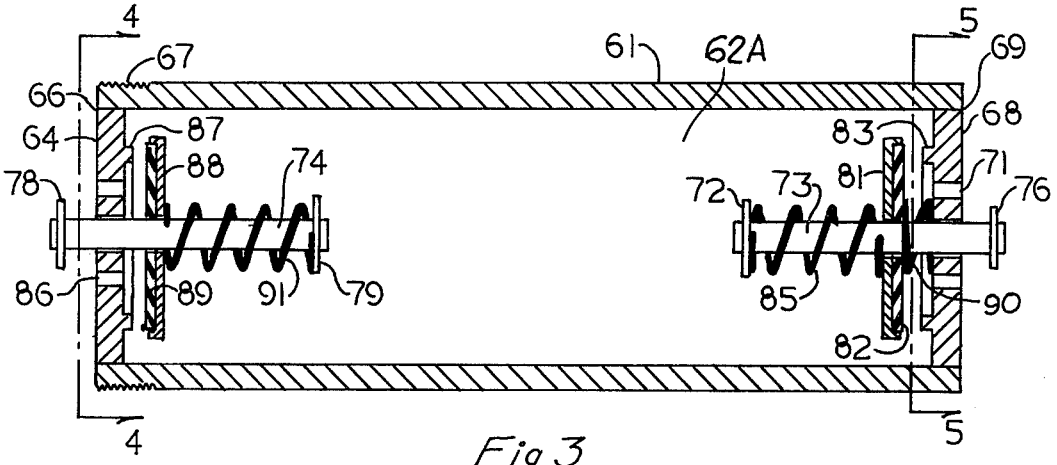
FIG. 3 is a sectional view of one anti-syphon valve arrangement within the scope of the present invention.
Figure 4:
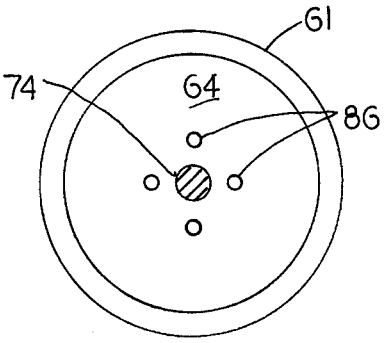
FIG. 4 is a view taken along a passing plane passing through line 4—4 of FIG. 3.
Figure 5:
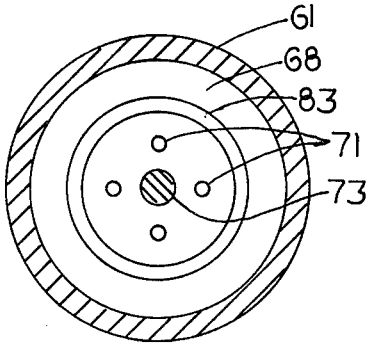
FIG. 5 is a view taken along a plane passing through line 5—5 of FIG. 3.

With reference to FIG. 3, one anti-syphon arrangement in accordance with the present invention is shown where the anti-syphon valve 61 defines an enclosure 62A. A disc 64 is press fit into the inlet end 66 of anti-syphon valve 61 defines an enclosure 62A. A disc 64 is press fit into the inlet end 66 of anti-syphon valve 61 where the inlet end is provided with threads 67 to be received in the aperture 62 defined in lower valve body 1. Likewise, a disc 68 is provided at the outlet end 69 of casing 61. With reference to FIG. 5, disc 68 includes fluid flow apertures 71 and a central aperture adapted to receive a stem 73. A similar arrangement is provided with respect to disc 64 as shown in FIG. 4 which is adapted to receive a stem 74. Stems 73 and 74 are freely movable through the central aperture in each of the discs 64, 68. Retainer rings 72, 76 are provided at the opposite ends of stem 73 while retainer rings 78, 79 are provided at the opposite ends of stem 74.

With respect to stem 73, a cup washer 81 is provided and is freely movable on stem 73 and a washer device 82, for example Neoprene (TM, E. I. Dupont, Inc.) is provided to be received within cup washer 81 so that the periphery of washer 82 engages a valve seat 83 provided around the inner periphery of disc 68. Thus cup washer assembly 81,82 provides a valve member to prevent flow of fluid through apertures 71 when washer 82 is urged against seat 83 and to permit fluid flow through apertures 71 when washer 82 is displaced from valve seat 83.

In accordance with another feature of the present invention, a spring member 85 is provided to surround stem 73 where the one end of spring 85 engages retainer 72 while the other end rests on the outermost surface of cup washer 81. Likewise, a second spring 90 is provided between disc 68 and cup assembly 81, 82. Springs 85, 90 are of selected spring constant so that in the absence of service fluid pressure in chamber 62A, when the main valve seat 18 is closed, cup assembly 81, 82 is biased to the open position in that spring 90 is of greater force than spring 85.

However when valve member 21 is open allowing the flow of fluid through the hydrant arrangement and the valve seat 18, the service fluid pressure and spring 85 is of greater force than spring 90 thereby closing valve seat 83. When valve member 21 is closed on valve seat 18 after operation of the hydrant residual fluid remains in standpipe 3 where the force exerted by the residual fluid and spring 85 is less than the force exerted by spring 90 to bias cup assembly 81, 82 to the open position to allow drainage of the residual fluid.

A somewhat similar arrangement is provided with respect to stem 74 where apertures 86 are provided in disc 84, to communicate with the inside of lower body 1, and disc 64 is provided with a valve seat 87. Likewise, stem 74 is provided with a cup washer, valve member 88 adapted to receive a washer 89 for engagement with valve seat 87. A spring member 91 is provided on stem 74 adapted to be retained between retainer ring 79 and the outermost surface of cup washer 88.

The relative characteristics of spring 91 are selected so that upon application of any fluid pressure whether service fluid pressure or residue fluid pressure to the underside of cup washer 88 (from standpipe 3) valve assembly 88, 89 opens allowing the fluid to drain into chamber 62A.

The loading of spring 91 is selected so that upon termination of operation of the hydrant when only the residue fluid pressure in the standpipe is applied to the device the pressure is sufficient to retain valve assembly 88, 89 in the open position but is insufficient to retain valve assembly 81, 82 in a closed position so that valve 81, 82 retracts from valve seat 83 permitting drainage of fluid from the valve assembly to prevent fluid syphoning through stand pipe 3, and upper body 6 "after the fluid has drained from the stand pipe". The valve assembly 88, 89 closes and acts as a check valve to prevent backflow of surface water through anti-syphon valve 61 into standpipe 3 but will permit backward gas flow to prevent syphon flow through standpipe 3.

Figure 6A:
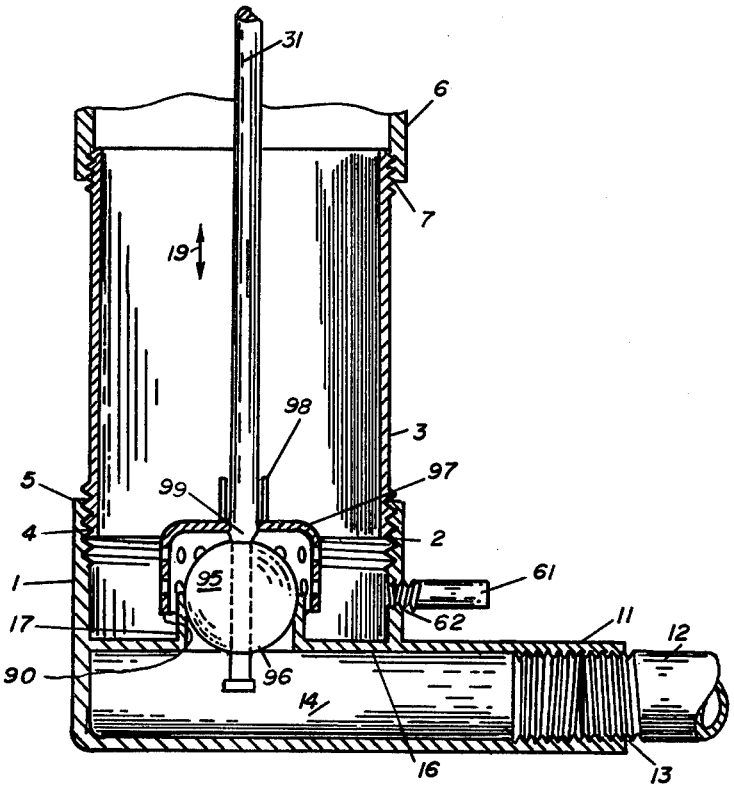
FIGS. 6A–B are cross sectional views of another arrangement in accordance with the present invention.
Figure 6B:
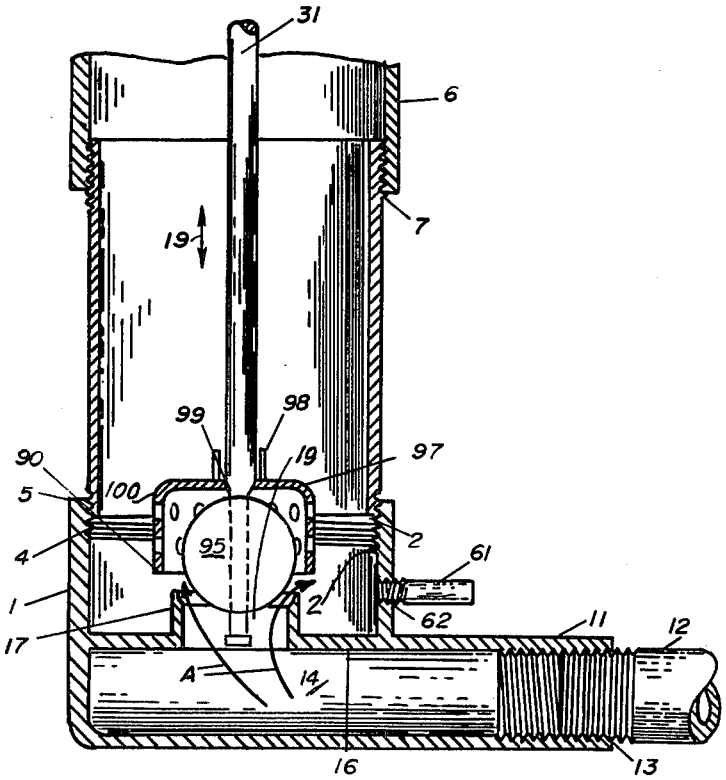

With reference to FIGS. 6*a*–6*b* which show an arrangement similar to that of FIG. 1 a hydrant arrangment includes a lower body 1 having an outlet 5 where a standpipe 3 is received in outlet 2, for example by means of cooperative threads 4 at the lower end of the standpipe 3 and the outlet end 2 of the lower body 1. At the upper end, standpipe 3 is connected to an upper body 6, by means of cooperative threads 7. The lower body 1 includes an inlet 11 adapted to receive an inlet conduit 12 by means of cooperative threads 13. An inlet chamber 14 is defined within the lower body 1 between the outer wall of body 1 and an intermediate wall 16 where intermediate wall 16 defines a valve seat support 17 all as previously described with reference to FIG. 1. In the case of FIGS. *6a–6b*, however, support 17 carries a elastomeric ball 95, for instance, a neoprene rubber ball, where the surface 96 of the elastomeric ball acts as a sealing surface. Normal fluid flow is in the direction indicated by arrow 19. Also provided within the arrangement is a cage 97 to prevent the elastomeric ball 95 from floating away from the valve seat support 17. The cage 97 is provided with a valve stem guide 98 and is connected to the valve stem 31 around the circumference of opening 99 by means known in the art such as by welding.

When the hydrant handle 47 (shown in FIG. 1) is raised as shown in FIG. 6B allowing the elastomeric ball 95 to disengage the value seat support 17 because of the service fluid pressure from inlet conduct 12 which allows fluid flow (shown by arrow 19) through the hydrant when the handle 47 is fully raised the cage sides 100 still engage the outside walls of the valve seat support 17 and thus prevent the elastomeric ball 95 from flowing away. In reverse operation, the hydrant handle 47 is closed lowering cage 97 and urging the elastomeric ball 95 to engage the valve stem support 17 to prevent back syphoning. Moreover, if the water supply to the inlet conduit 12 is stopped for any reason, the elastomeric ball 95 will fall into the valve stem support 17 and prevent backflow of fluid into the lower body 1 of the hydrant arrangement.

Figure 7:
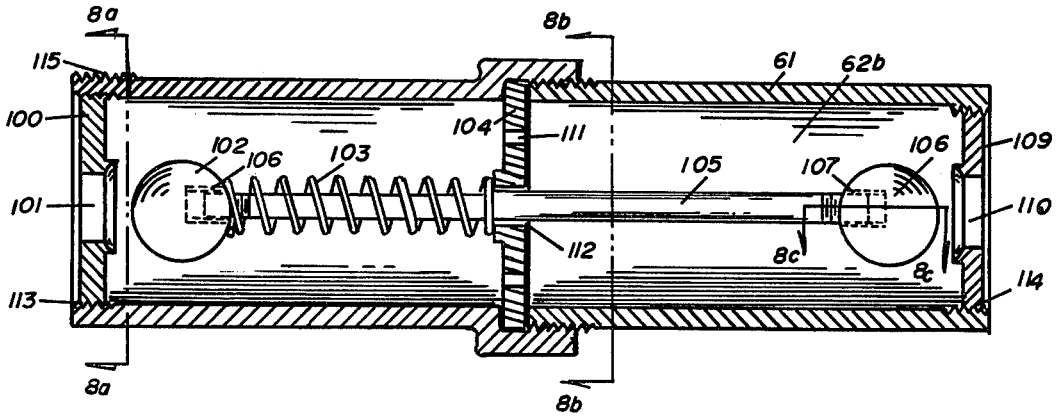
FIG. 7 is a cross-sectional view of another anti-syphon valve in accordance with the present invention.

Similarly, anti-syphon valve assembly 61 is provided with an arrangement as shown in FIG. 7 where anti-syphon valve 61 defines an enclosure 62*b*. A disc 100 having a fluid flow aperture 101 is press fit into the inlet end 113 of the anti-syphon valve 61 where the inlet end is provided with threads 115 to be received in the aperture 62 defined in lower body 1 as shown in FIGS. 1 and 6. Likewise a disc 109 having a fluid flow aperture 110 is provided at the outlet end 114 of the valve assembly 61. A third disc 104 is provided in the center of the valve assembly 61 with fluid flow aperatures 111 and a central aperture 112 as shown in FIGS. 7 and 8*b* to receive guide center rod 105. Guide center rod 105 has an elastomeric ball 102 connected to the end adjacent disc 100 and a elastomeric ball 106 connected to the opposite end of the guide center rod 105 adjacent disc 109. Elastomeric balls 102 and 108 each have threaded inserts 106 and 107 respectively to receive the appropriate ends of the guide center rod. Additionally, a spring 103 of selected spring constant is provided between elastomeric ball 102 and disc 104 to urge elastomeric ball 102 to a closed positon against aperture 101 of disc 100 when there is no fluid pressure in standpipe 3 thus preventing the backflow of ground surface water through the anti-syphon valve 61 into the hydrant arrangement and standpipe 3 as shown in FIGS. 1 and 6.

In operation, the anti-syphon valve 61 works as follows. When the hydrant arrangement is open and the service fluid pressure from inlet conduit 12 is flowing through the hydrant arrangement, said service fluid pressure will overcome the selected spring contact of spring 103 and urge the elastomeric ball 106 to engage the fluid flow aperture 110 of disc 109 to prevent the discharge of fluid from the hydrant assembly through aperture 110.

However, when the hydrant handle 47 is closed causing the elastomeric ball 95 to engage the valve seat support 17 thereby stopping the service fluid flow from inlet conduit 12 or when the water supply to inlet conduit 12 is stopped for any reason and the elastomeric ball 95 automatically closes the valve inlet seat 17 as previously discussed the fluid remaining in the hydrant assembly and standpipe 3 automatically drains out of the standpipe through anti-syphon valve 61. This occurs because the fluid pressure in standpipe 3 is equal to the spring constant of spring 103 and therefore both elastomeric balls 102 and 108 remain in an open position in relation to their respective apertures 101 and 110 of their respective discs 100 and 109. Once the fluid in the standpipe 3 has drained from the hydrant assembly through the anti-syphon valve 61 spring 103 urges the elastomeric ball 102 to a closed position against aperture 101 of disc 100 to prevent back flow of surface water through the anti-syphon valve 61 and into the standpipe 3 of the hydrant assembly. Because the elastomeric balls 102 and 109 are connected by the center guide rod 105, the two elastomeric balls 102 and 108 move in direct relation to each other.

Figure 8A:
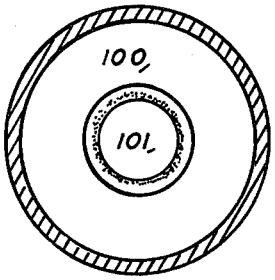
FIGS. 8A–8C are views taken along planes passing through lines 8A–8C of FIG. 7.
Figure 8B:
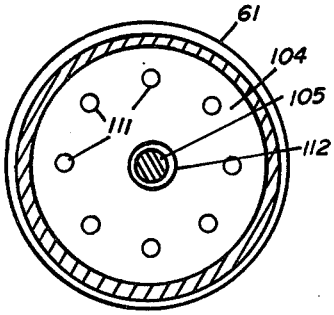
Figure 8C:
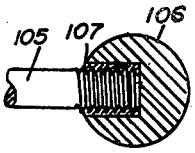

FIGS. 8*a*, 8*b* and 8*c* are cross sectional views taken along the planes passing through 8*a*–8*g* to show respectively disc 100 with its fluid flow aperture 101, disc 109 with its fluid flow aperture 111 and the elastomeric ball 108 with its appropriate threaded insert 107.

It will be recognized that other arrangements within the scope of the present invention will occur to those skilled in the art upon reading the disclosure set forth hereinbefore.

The invention claimed is:

1. An anti-syphon frost proof hydrant including:

a. a lower body having a fluid inlet adapted to be connected in communicative relation to a source of liquid, a fluid outlet defined by a first valve seat drain port;

b. standpipe means connected to said lower body in communicative relation with said first valve seat and anti-syphon drain port;

c. an upper body adapted to be carried by said standpipe means having a fluid inlet in communicative relation with said standpipe means and said first seat and a fluid outlet;

d. first valve stem means extending through said upper body and generally longitudinally through said standpipe means for longitudinal movement therein;

e. first valve means carried at the end of said stem means and operable by longitudinal movement of said stem means from a first position to seat on said valve seat to a second position in spaced relation from said valve seat to permit liquid flow through said valve seat at first selected pressure; and f. syphon control valve means including a housing adapted to be received in said drain port of said lower body wherein said housing has an inlet in communication with said standpipe and an outlet, first housing valve means adapted to open and close said inlet housing; biasing means to normally urge said first housing valve means to a closed position in response to a first level of liquid in said standpipe and to permit said first housing valve means to open when the liquid level in said standpipe exceeds said first level to selectively permit flow of liquid into said housing; second housing valve means adapted to open and close said outlet of said housing including bias means to urge said second housing valve means to open said outlet until liquid pressure in said standpipe is equal to the pressure exerted by said liquid when said standpipe is full of liquid at static conditions, and to urge said second housing valve to open said outlet when the pressure exerted by said liquid in said standpipe is less than the pressure exerted by said liquid in said standpipe when said standpipe is less than liquid full at static conditions.

2. The invention of claim 1 wherein said first valve means is connected to said valve stem by spring means so liquid normally flows from said lower body inlet through said lower body fluid outlet into said standpipe when said valve stem is in said second position and where said spring means permits said first valve means to close off said lower body fluid outlet on reverse flow of fluid through said standpipe.

3. The invention of claim 2 wherein said first valve means includes flexible flap means connected on one side to said spring means and at one edge to said lower body where said flexible flap means is operable from first position where the side of said flexible flap means opposite the side connected to said spring means engages said first valve seat to close said fluid outlet in said lower body and to second position where said flexible flap is in spaced relation from said fluid outlet in said lower body.

4. An anti-syphon frostproof hydrant including:

a. a lower body having a fluid inlet adapted to be connected in communication relation to a source of liquid, a fluid outlet defined by a first valve seat and a drain port;

b. standpipe means connected to said lower body in communicative relation with said first valve seat and drain port;

c. an upper body adapted to be carried by said standpipe means having a fluid inlet in communicative relation with said standpipe means, said first valve seal and said fluid outlet;

d. first valve stem means extending through said upper body and generally longitudinally through said standpipe means for longitudinal movement therein;

e. elastomeric ball means;

f. cage means carried at the end of said stem means and operable by longitudinal movement of said stem means from a first position where said cage means urges said elastomeric ball means to seat on said first valve seat to a second position in spaced relation from said first valve seat to permit liquid flow through said first valve seat at a first selected pressure when said liquid at a first selected pressure urges said elastomeric ball means away form said first valve seat; and g. syphon control valve means including a housing adapted to be received in said drain port of said lower body wherein said housing has an inlet in communication with said standpipe and an outlet, first housing valve means adapted to open and close said inlet housing; biasing means to normally urge said first housing valve means to a closed position in response to a first level of liquid in said standpipe and to permit said first housing valve means to open when the liquid level in said standpipe exceeds said first level to selectively permit flow of liquid into said housing; second housing valve means adapted to open and close said outlet of said housing including bias means to urge said second housing valve means to open said outlet until liquid pressure in said standpipe is equal to the pressure exerted by said liquid when said standpipe is full of liquid at static conditions, and to urge said second housing valve to open said outlet when the pressure exerted by said liquid in said standpipe is less than the pressure exerted by said liquid in said standpipe when said standpipe is less than liquid full at static conditions.

5. The invention in claim 4 where said syphon control valve means further includes check valve means to prevent liquid backflow and permit gas backflow through said syphon control valve means.

* * * * *